US005518016A

United States Patent [19]

Sharwark

[11] Patent Number: 5,518,016

[45] Date of Patent: May 21, 1996

[54] METHOD OF MOUNTING A WATER FAUCET

[76] Inventor: Norman J. Sharwark, 9850 Sceptor Ave., Brooksville, Fla. 34613-5010

[21] Appl. No.: 406,482

[22] Filed: Mar. 20, 1995

[51] Int. Cl.[6] ..... F16L 55/18; F16K 21/00

[52] U.S. Cl. ..... 137/15; 137/359; 137/801; 4/676

[58] Field of Search ..... 4/675, 676; 137/359, 137/801, 15

[56] References Cited

U.S. PATENT DOCUMENTS

| | | | |
|---|---|---|---|
| 3,010,474 | 11/1961 | Moen | 137/359 |
| 3,190,306 | 6/1965 | Staat et al. | 137/359 |
| 3,443,266 | 5/1969 | Mongerson et al. | 137/359 |
| 4,760,861 | 8/1988 | Botnik | 4/675 |
| 4,804,010 | 2/1989 | Meissenburg | 4/675 |

FOREIGN PATENT DOCUMENTS

| | | | |
|---|---|---|---|
| 1060226 | 3/1954 | France | 137/359 |

*Primary Examiner*—A. Michael Chambers
*Attorney, Agent, or Firm*—Frijouf, Rust & Pyle

[57] ABSTRACT

An apparatus and method is disclosed for an improved faucet and mounting, which enables the installation and removal of the faucet from the top side of a sink. FIGS. 1 and 3 of the drawings are substantially identical except for the manner for delivering water to the faucet structure. In both of the illustrations, the conventional means for clamping the faucet to the deck of a sink are eliminated. The invention is illustrated in place thereof.

In FIG. 1, the substantially universal mount, using supply nipples both to anchor, and to supply water, hot and cold, is replaced by elimination of the function of the supply line as anchor means. In essence, this invention teaches extending a pair of spaced apart bolts downwardly through the lateral body structure of a faucet, into engagement with threaded receptors carried by a sink deck, thereby exerting a clamp action to stabilize the faucet, and when removed, will allow the faucet to be lifted free of the sink, and will pull the water supply tubing up through the standard openings of the sink. An example of such sink would be a laundry tub or kitchen sink.

4 Claims, 2 Drawing Sheets

METHOD OF MOUNTING A WATER FAUCET

DEFINITIONS

The name "sink" is used generically for kitchen sinks, laundry tubs and bathroom lavatories.

Slack: that excess beyond the minimum needed to reach from water supply lines to a faucet mounted on a sink.

Speed nut: A specialty fastener by Tinnerman Co., Post Office Box 1148, Conover, N.C. 28613.

1. Field of the Invention

This invention relates to water supply faucet and mountings.

2. Background of the Invention

Modern technology has solved many complex problems, for example the overwhelming accomplishments in computer and similar electronic structures, space flight, and other very complex and useful tools for mankind. However, in the rush to develop high technology, many of earth's nagging problems remain unsolved.

Anyone who has removed and reinstalled a water faucet on a kitchen sink will be well aware of the exasperating difficulty of getting the replacement structure connected to the water service lines and clamped tight against the counter deck surface provided at the sink for mounting the faucet.

Almost universally, the tub, sink or basin has a shelf deck on which a faucet sits, and a series of openings to enable water service connection through the openings.

In one known means for mounting water control faucets on the deck of the supporting basin is depicted in FIG. 1. Two short stub pipes, with threads on the external surface, protrude out of the bottom surface of the faucet. These pipes are usually threaded pipe nipples and are provided to tie the faucet to an indigenous water service line. A compression bushing surrounds the pipe in order that the nut may be tightened to compress the bushing into a water tight seal. Usually, a second nut and large washer are used to clamp the faucet to the sink deck by exerting a clamping pressure on the faucet. Thus the faucet is both supplied with water and clamped to the shelf of the sink on which it is installed. It is the elimination of such prior art clamping device that constitutes the object of this invention.

Referring to FIG. 3 of the drawings, wherein tubes 27 and 28 extend through the central opening, no clamping action is provided in the prior art faucet, to use the supply lines for providing anchoring forces. Rather, bolting action from the lower surface extends upwardly through the sink deck to engage and draw the lateral extensions of the faucet body to the deck surface.

Both of these prior art devices are so well known that no drawing to illustrate the prior art is appropriate for this background discussion. Both clamping means have been eliminated by this invention as will now be further described.

A computer search of means for mounting faucets has been made, with no similarity to the present invention. Also, personnel of a large plumbing supply house have been interviewed, simply asking for instructions on how to mount a water distribution faucet without getting under the sink. No teaching was forthcoming except to enter into the cabinet as has been done for many years.

DETAILED DISCUSSION OF THE BACKGROUND

In all known prior art constructions thus described, the very difficult procedure still remains of working under the sink to clamp the faucet to the deck.

The object of this invention is to make the faucet structure readily removable and a new faucet or repaired faucet installed, working from the top of the sink without the need of physically working in the support cabinet under the sink. The prior art requires exasperating labor to gain access under the sink to release the supply and clamping structures. Some people with physical infirmities are unable to work in such confining cabinet, but may easily install and replace the faucet using the present invention.

This invention, once the faucet is installed, may thereafter be removed and replaced from the top side of the sink, thereby eliminating the present method with need to work under the sink to service the faucet.

The universal means for mounting a faucet of the type illustrated in FIG. 1, is to provide a short stub pipe nipple 30 with threads on the external surface. The threaded nipples protrude out of the bottom surface of the faucet base. Compression fittings surround the supply line in order that the water line may be tightened to compress the bushing into a water tight seal.

In a second means, as shown in FIG. 3, the water service lines to the faucet valve, are quarter inch copper tubing bundled together as hot and cold supply lines 27 and 28. The tubular supply lines pass through a central opening provided during the manufacture of the sink. These lines fasten directly to the faucet valve. Reference to the two faucet types is for background comparison only and are well-known.

The foregoing has outlined the more pertinent objects of the present invention. The objects should be construed as being merely illustrative of some of the more prominent features and applications of the invention. Many other beneficial results can be obtained by applying the disclosed invention in a different manner or modifying the invention within the scope of the invention. Accordingly other objects and a full understanding of the invention may be had by referring to the summary of the invention, and the detailed description describing the preferred embodiment, in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarization, the invention relates to an improved method and apparatus for releasably securing a faucet from the top side of an associated tub, sink, or basin.

In this invention, fastening bolts pass through the faucet body, and engage threaded anchor means carried by the supporting sink to provide physical clamping action.

The foregoing has outlined rather broadly the more pertinent and important features of the present invention in order that the derailed description that follows may be better understood and that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DESCRIPTION OF THE PREFERRED EMBODIMENT

This invention will be described in the environment of a kitchen sink, laundry tub or the like, because that is the usual environment in which we find flow control valves for domestic use.

A sink, or basin 10, is designed to hold a body of water for many purposes, such as kitchen dish washing, soaking laundry and, for example, clean-up tub for garden and shop clean-up.

In any event, whether basin, sink or by some other name, the normal practice is to provide a deck area 16 upon which the faucet is seated during its proper use. The common environments which provide a flat surface for seating a faucet, is (1) a counter top made of a structural core with various top surface paving, and (2) a stainless steel sink with a faucet shelf area.

Figure 1:
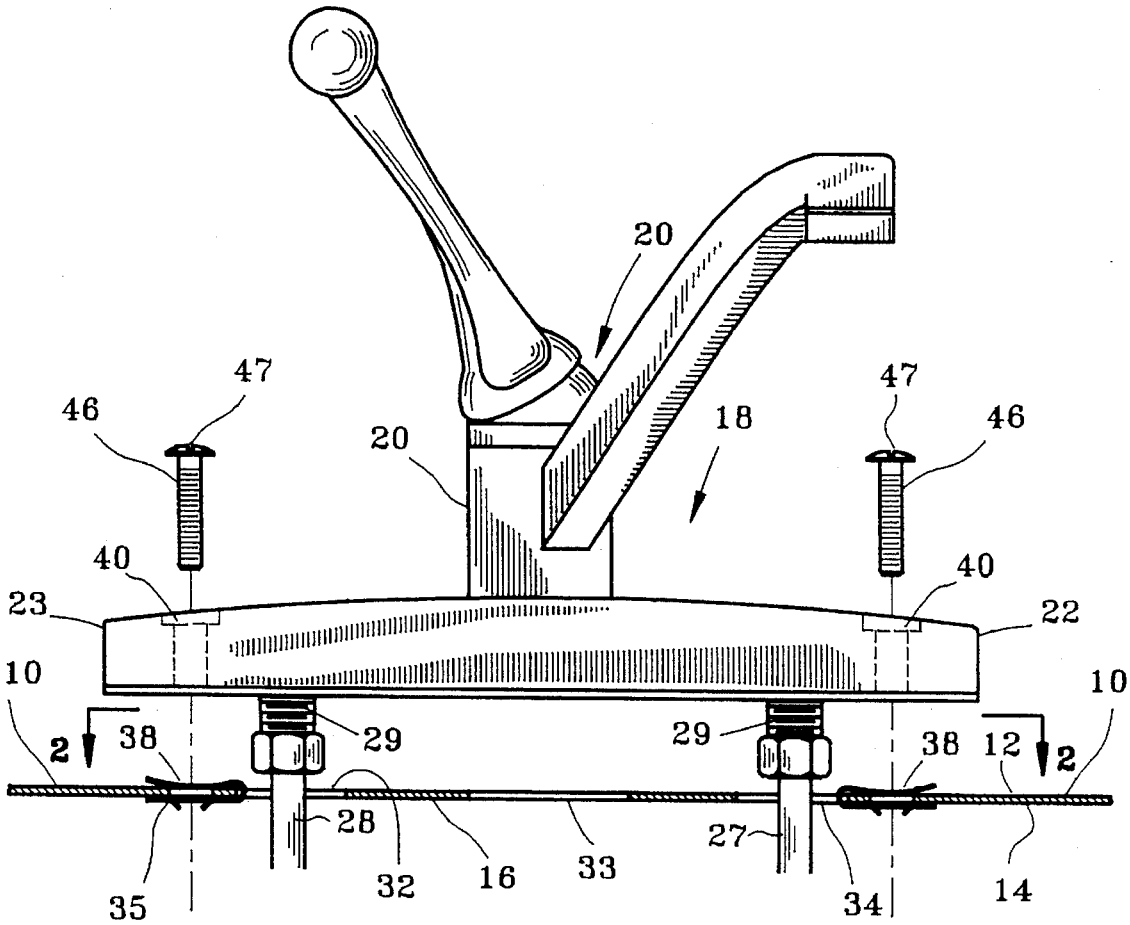
FIG. 1 of the drawing is an elevational view of a standard swing arm valve control faucet with a fragment of a counter or deck of a sink upon which the faucet is mounted.

In order to explain the invention, which is the essence of simplicity, but with astonishing favorable results, a section through the deck portion of kitchen sink 10 is shown in FIG. 1. Also, in order to fully describe and teach the invention, the top and bottom of the deck area, will be referred to as the top side 12 and the blind side 14. When one gets under the cabinet to service a prior art faucet, and views the bottom of the sink 10, only the blind side is visible. When viewed in normal use, the top side 12 is visible.

In the FIG. 1 of the drawings, a faucet 18 of essentially standard design has been employed as a teaching tool. The invention, to obtain access to service, install repair and replace a faucet 18 will be carefully delineated for instruction purposes.

Base 19 of the single lever distribution faucet illustrated at FIG. 1 has no other name known except that it is a base for the faucet.

Centrally of the base 19 is an area termed a faucet central valve housing portion 20, which is the area in which the valve mechanism is located.

In the illustrated embodiment, the base is comprised of two lateral base portions 22 and 23. The base portion is widely variable in normal practice, attempting mainly to please the eye for appearance sake.

Figure 3:
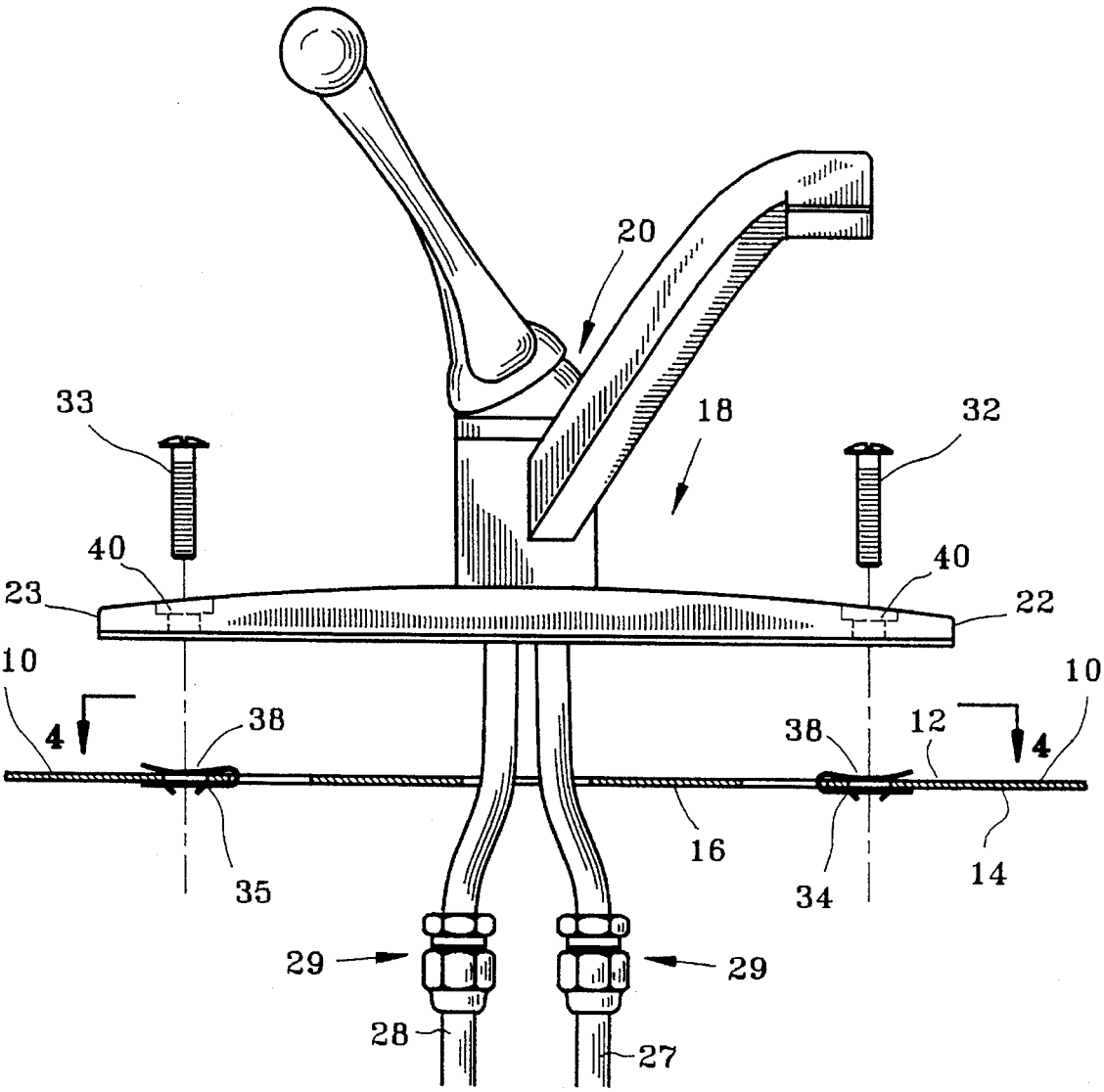
FIG. 3 is an elevational view of a standard swing arm valve control faucet identical to FIG. 1 in-so-far as this invention is concerned.

The faucet is supplied from hot and cold tubes 27 and 28 respectively. Nipples 30 are intake ports to receive service from tubes 27 and 28. Compression fittings 29 secure the service lines 27 and 28 to the nipples 30, or lines 27 and 28 as in FIG. 3, and also form a water-tight fitting to contain the water which is under pressure.

Therefore, in accordance with this invention, a new and much superior means of securing the faucet base portions 22 and 23 to the deck 16 is provided.

The manufacture of basins; such as tubs and sinks, has become universally standard in producing holes in the deck area 16 in order that standard configuration faucets and water service lines may be interchanged and used in any manufactured basin. To do otherwise would be to cause mass confusion.

Figure 2:
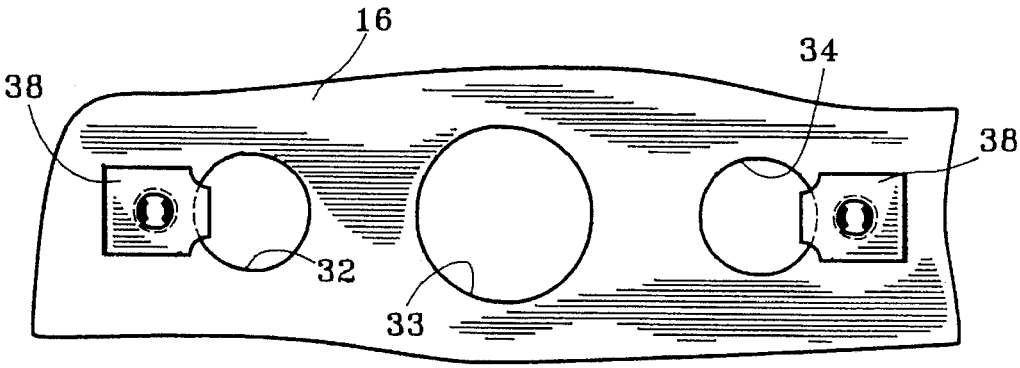
FIG. 2 is a fragment of a counter or deck its seen along the line 2—2 of FIG. 1.
Figure 4:
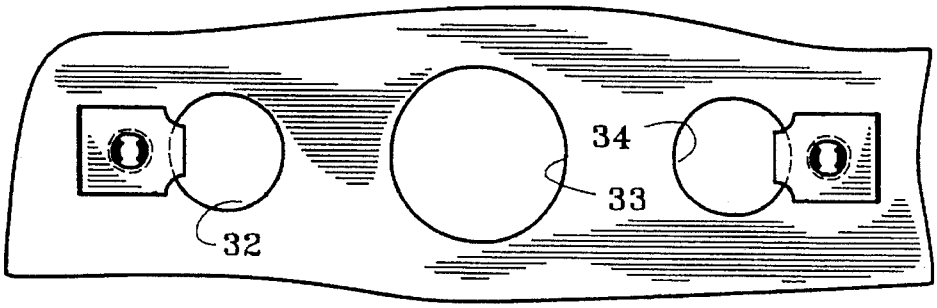
FIG. 4 is a fragment of a sink counter deck as seen along lines 4—4 of FIG. 3.

The openings referred to are indicated by reference numbers 32, 33, and 34 in FIG. 2 and FIG. 4.

To fully understand this invention, it must be kept in mind that as thus far described, the presently available way of clamping a faucet base to a deck of a sink has been eliminated. The substituted compression fittings 29 have no interference faces with the structure of the basin, and therefore do not aide in holding or releasing the faucet.

The structure for providing the benefits of the present invention are embodied in two anchors which operate from the topside of the basin without access to the blind side.

If the sink deck 16 were thick enough to be threaded, no further means would be necessary. However, the stainless steel sinks used in kitchens, and the plastic material normally used in laundry tubs, are not of sufficient gauge to be successfully threaded.

A first set of openings through the deck is actually a composite of bore 40 and a slip-on nut 38. The slip-on nut is a well-known holder for positioning the function of a nut in inaccessible areas. Tinnerman Co. of Conover, N.C., U.S.A. supplies a nut that serves as a unitary threaded nut. The trademark "speed nut" is used to identify the Tinnerman nut. See U.S. Trademark Registration No. 517,759. "Slip-on" is a generic term. These are practical devices, and not a claimed part of this invention. Access for a bolt 46 is through the bore 40 and through the engaging surfaces of the nut 38.

The key to the successful implementation of this invention is in the elimination of using the ancient compression fitting concept to also supply clamping action. The prior use requires a faucet wrench working from the blind side of the sink, and substitution of the clamping action of this invention accomplished by the bolt 46 engaging slip-on nut 38. This invention employs bolt 46 extending through opening 32 or 34 into engagement with the "slip-on" speed nut 38. The nut 38 is illustrated as a top plan view in FIG. 2 and FIG. 4. Opening 32 and 33 enables the nut 38 to be moved into position with the planar deck 16, and slipped laterally until the threaded surfaces provided by the nut 38, are aligned with the bore 40. The bolt 46, extending through bore 40 and into threaded engagement with the speed nut 38, enables the bolt 46 to be threaded into an effective engagement with the surface of the deck 16. Such speed nuts are normally not mechanically fastened to the deck 16, because once engaged by bolt 46, no lateral shifting of the speed nut with respect to the bolt 46 is possible.

By eliminating the conventional difficult fastening means of the prior art, and substitution of a clamping nut in a cooperating engagement with the deck 16, the advantages and benefits provided are outstanding, and obtained by the simplicity of the concept herein disclosed.

With this arrangement, the faucet, after having been supplied with water supply structures, is assembled by dropping the threaded bolt 46 through the bore 40 and into engagement with the nut carried by the slip-on holder or equivalent, and tightened by conventional driver tool to produce the necessary clamping action between the deck and the faucet base.

There is a distinct advantage in using a slip-on nut carrier to provide the threaded opening through the deck of the sink, and that is even though it is intended to make standard spacing, it is possible that a very small variation between manufactures could take place, or even an error of production from the same manufacturer. Therefore, by using a slip-on nut clipped to the side of the deck opening 32 and 34, as the threaded bolt descends into engagement with the respective threaded opening, slight lateral shifting is automatically obtained. Perfection is thereby eliminated for practical considerations.

As thus fully described, the bolts and threaded openings cooperate to clamp the base portions of the faucet to the basin deck, and thereby prevent removal of the faucet upwardly from the deck of the sink. Removal of screws 46 enables the vertical movement referred to, and such vertical movement will bring with it the supply lines and compression fittings where they may be serviced from the top side of the sink. Thus, the faucet is first removed, serviced and/or replaced, and then reattached to the service lines. Whereafter, the threaded bolts 46 are re-engaged with the threaded nuts 38, and the job is finished.

It is a condition of this invention that the supply lines be longer than in conventional practice, and flexible, in order to provide mobility in lifting the faucet off of the deck. The compression fittings are thus exposed for removal from the top of the basin or sink.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. The improved method of removably securing a faucet to a sink rim shelf, said sink rim shelf having at least two through openings for passage of water supply tubes to said faucet, said method comprising:

installing a "U"-shaped slip-nut in each of two through openings by clipping the slip-nut onto an edge of an opening and advancing the nut laterally to clip the threaded nut surfaces thereof away from the opening, thereby providing two spaced anchors carried by the sink structure, and extending anchor bolts through the faucet and the related slip-nut, whereby, said faucet may be installed or removed working only from the top side of the sink.

2. The method of claim 1 wherein flexible water service lines interconnect source lines and the faucet and are of a length at least about three inches slack to enable the faucet to be separated from said rim shelf with clearance to enable structural service above the sink top side.

3. In the environment of a sink having a top side and a blind side, with water service below said blind side, the improvement of means for mounting and securing a faucet in place on said sink top side, comprising:

a valve for control of flow from water service lines;

a housing for said valve, said housing having first and second lateral extensions lying along a common plane for seating upon the horizontal plane surface of the counter deck;

said first housing extension having a first through opening vertical bore spaced from said valve along said axis:

a second housing extension having a second through opening vertical bore spaced from said valve along said axis on the opposite side of said valve housing from said first vertical bore; and means for mounting a threaded receptor on said counter deck spaced to be in alignment with said first housing vertical bore;

means for mounting a threaded receptor on said counter deck spaced to be in alignment with said second housing vertical bore;

whereby a threaded bolt extending through each said first and second vertical bore and into engagement with the respective threaded receptor may be tightened to draw the faucet base into a locked mounting on said counter deck, and may be released by reversing the bolt rotation to release the faucet for repair or replacement without need to work from the sink blind side.

4. In the environment of a basin having a top and a blind side, with a deck area to provide a support for a faucet, and at least one opening through said deck area to supply line access to a faucet mounting on said deck, the invention comprising:

a faucet having first and second longitudinally extending base portions, a valve located at a central portion of said base portions for flow control through said faucet valve;

a first set of openings through a first of said base portions and through the said basin deck;

said opening through said basin being threaded;

a second set of openings through a second of said base portions and through the said basin being threaded;

said opening in the faucet base portion aligned with the threaded opening, and a headed bolt extending through each said first set of openings and said headed bolt having interference surfaces with the faucet base portion;

whereby, said bolts and threaded opening cooperating to clamp said base portion to said basin deck, and prevent the removal of said faucet upwardly from said base portion until repair or replacement faucet has been made, whereupon the faucet is re-established on said deck without need for blind side access.

* * * * *